US005299176A

United States Patent [19]

Tibbetts

[11] Patent Number: 5,299,176

[45] Date of Patent: Mar. 29, 1994

[54] BALANCED ARMATURE TRANSDUCERS WITH TRANSVERSE GAP

[75] Inventor: George C. Tibbetts, Camden, Me.

[73] Assignee: Tibbetts Industries, Inc., Camden, Me.

[21] Appl. No.: 811,308

[22] Filed: Dec. 20, 1991

[51] Int. Cl.[5] ..... H04R 25/00

[52] U.S. Cl. ..... 367/175; 367/182; 381/199; 381/200

[58] Field of Search ..... 381/192, 199, 200, 193, 381/171; 367/175, 182, 178, 140

[56] References Cited

U.S. PATENT DOCUMENTS

| | | | |
|---|---|---|---|
| 2,927,977 | 3/1960 | Knauert | 381/200 |
| 3,002,058 | 9/1961 | Knowles | 381/200 |
| 3,111,563 | 11/1963 | Carlson | 381/200 |
| 3,177,412 | 4/1965 | Carlson | 381/200 |
| 3,185,779 | 5/1965 | Sawer | 381/200 |
| 3,249,702 | 5/1966 | Carlson | 381/200 |
| 3,491,215 | 1/1970 | Bercovici | 179/114 |
| 3,617,653 | 11/1971 | Tibbetts | 381/200 |
| 3,671,684 | 6/1972 | Tibbetts et al. | 381/200 |
| 4,000,381 | 12/1976 | Plice et al. | 179/114 M |
| 4,015,227 | 3/1977 | Riko et al. | 335/231 |

OTHER PUBLICATIONS

Nasar, et al., "Linear Electric Motors: Theory, Design and Practical Applications", Prentice Hall, Inc., 1987, pp. 233-239, 252.

*Primary Examiner*—J. Woodrow Eldred
*Attorney, Agent, or Firm*—Lahive & Cockfield

[57] ABSTRACT

An electromechanical transducer having permanent magnet means forming a bias field in a region between poles, and a vibratable armature having a first part in that region. The armature has a second part extending from the first part substantially externally of that region. Magnetically permeable structure includes a portion opposing the second part across a transverse gap. The latter structure is included in a closed magnetic loop comprising said first and second parts, a working gap in said region and the transverse gap, and an electrical signal coil is threaded by the loop.

21 Claims, 7 Drawing Sheets

BALANCED ARMATURE TRANSDUCERS WITH TRANSVERSE GAP

SUMMARY OF THE INVENTION

The present invention is directed generally to balanced armature electromechanical transducers, and more particularly to transducers of relatively high efficiency and coupling coefficient that are applicable to practical electroacoustic transducers of the type described in the copending patent application of George C. Tibbetts and Peter L. Madaffari, filed on even date herewith and entitled "Non-Occludable Transducers for In-the-Ear Applications." The transducers of this invention also have many other potential applications. Balanced armature transducers have an armature of magnetically soft material intended to carry signal flux, and the armature is in approximate balance when this flux, in the absence of electrical and mechanical signals to the transducer, is small compared with magnetic saturation of the armature.

It has been proposed to construct small elongate electromechanical transducers with application to non-occludable electroacoustic transducers insertable in the human ear canal. Heretofore these transducers have been of the electrodynamic type, in which a so-called voice coil, carrying signal current, moves in a static magnetic field. Such transducers appear to be inapplicable in practical use because of the very high copper loss, and consequent very low efficiency and electroacousticsensitivity, characteristic of electrodynamic devices in the very small sizes required for this application.

Balanced armature transducers are preferable for this type of application, to reduce the copper loss to an acceptable level, while maintaining acceptable linearity of operation (within the limits of saturation of the armature). Prior art balanced armature motor units, however, have not had the compact structure, elongate shape, and direction of actuation necessary for transducers of the type disclosed in said copending application.

In conventional current art balanced armature transducers the armature of magnetically soft material also functions as its own restoring spring, a portion of the armature being substantially fixed to provide the spring function and to convey signal flux between the armature and the remainder of the magnetic structure. In the transducers of said copending application, there is insufficient room to employ an armature of this combination type in a structure that will provide useful signal flux capability and limit stresses in the armature to less than the yield point.

With a view to overcoming the above problems with prior art transducers, the present invention employs, in a preferred embodiment, an armature which comprises a first, central portion having a pair of opposed major faces, a skirted portion which at least partially surrounds the central portion and which also has a substantial projection or extension along normals to a major surface of the central portion, and magnetically permeable material interconnecting the central and skirted portions. Preferably the magnetically soft material is integral with the central or skirted portion, or with both. A pair of magnets, or optional pole pieces associated with the magnets, oppose the major faces of the central portion, forming working gaps which vary as the armature vibrates, the magnets or pole pieces supplying polarizing flux in the region of the working gaps.

A substantially stationary magnetically permeable structure faces the skirted portion across a gap or gaps transverse to the working gaps. Preferably the reluctance of the transverse gap or gaps does not vary appreciably as the armature vibrates in the desired direction of actuation. The stationary magnetic structure is partially in a closed magnetic loop that includes a magnet, a working gap, the central portion, the interconnecting magnetically soft material, the skirted portion, and a transverse gap. An electrical signal coil is threaded by this loop, and is coupled to the flux variations substantially associated with only one working gap. Preferably there is at least a pair of such signal coils, which optionally may be connected electrically in series or parallel, or may be connected independently to electrical terminals of the transducer. The armature is stabilized against magnetic snap over by at least one discrete restoring spring. Preferably the armature is supported by a central pin which extends to or through the central portion, and which also extends to the restoring spring, which may be remote from the armature. Mechanical connection to the armature, to provide electromechanical transducer function, may also be made by the central pin.

DETAILED DESCRIPTION

Figure 1:
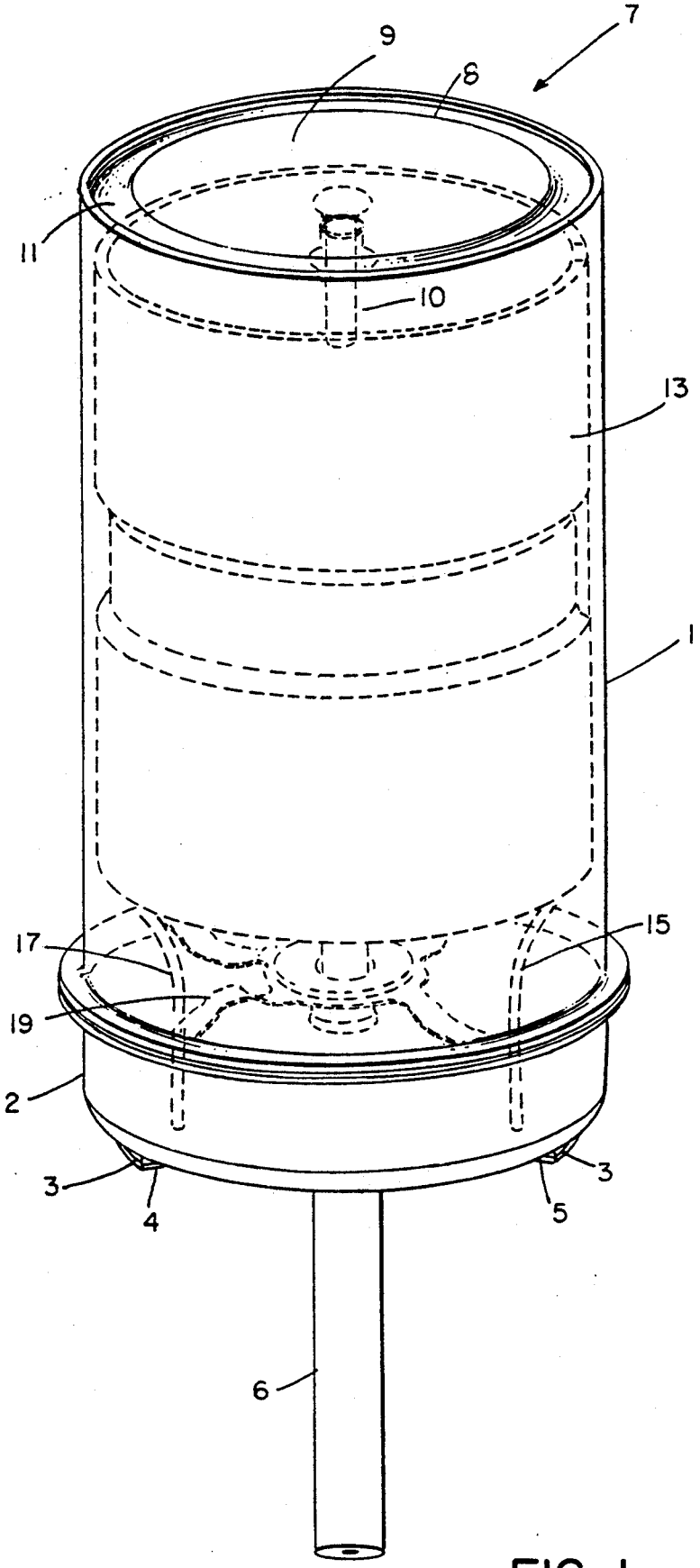
FIG. 1 is a composite view of an electroacoustic transducer incorporating a first embodiment of the invention.

FIG. 1 shows an example of an electroacoustic transducer according to the disclosure of said copending application in which the electromechanical transducers of the present invention may be applied.

The casing of the transducer is substantially cylindrical and of circular cross section, and comprises a flanged tube 1 and a flanged terminal cup 2. The flanges are welded together, and the welds may extend through the peripheral rim of a restoring spring 19 (hereinafter described) fixed between the flanges. The cup 2 carries a terminal board 3, which has electrical terminal pads 4 and 5. An atmospheric vent 6 passes through an aperture in the cup 2 and is adhesive bonded thereto. A diaphragm assembly 7 closes the opposite end of the tube 1 and is sealed to it by adhesive. The diaphragm assembly 7 has a central portion 8 which is provided by a substantially circular diaphragm reinforcement 9. High strength polymer film covers and is hot adhesive bonded to the diaphragm reinforcement 9. The film extends into a free diaphragm surround 11 which is arched inwardly by hot forming. Beyond the surround 11 the film is hot formed into a skirt which subsequently is adhesive bonded to the inner wall of the tube 1. Since there is no passageway through the diaphragm assembly 7, the necessary equalization of static pressure on each side of the diaphragm assembly is provided by the atmospheric vent 6.

Figure 2:
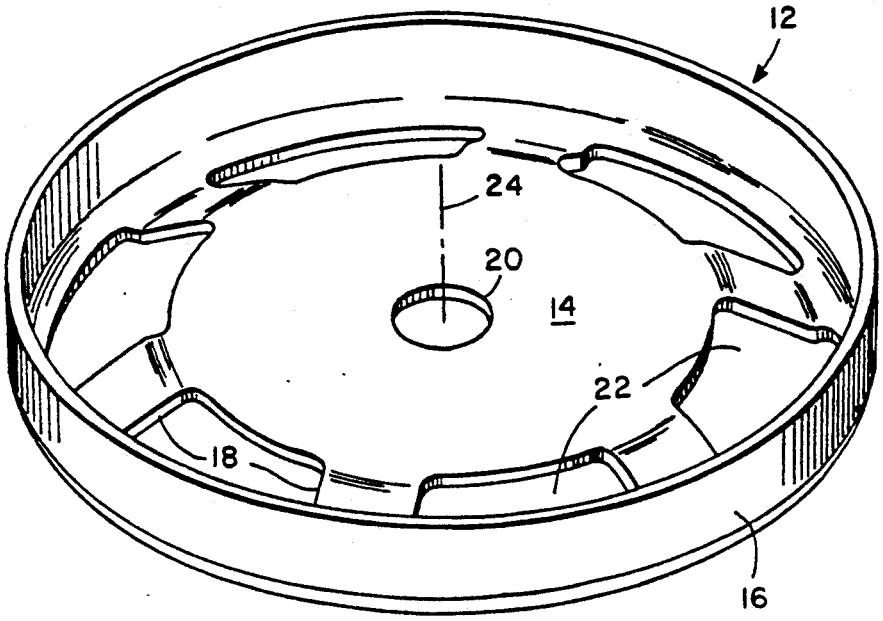
FIG. 2 is a detail view of the armature of the first embodiment.

FIG. 2 is an isometric view of a circular armature 12 that is adapted to the electroacoustic transducer of FIG. 1. The armature 12 has a central portion 14 in the form of a plate, and a skirted rim 16 which is connected to the central portion 14 by six spokes 18. The central portion 14 has an aperture 20 for mechanical connection to the armature 12. The armature 12 is fabricated by drawing a cup from strip, blanking the aperture 20 and six apertures 22, forming the apertured bottom of the cup to approximately center the central portion 14 along a central axis 24 with respect to the rim 16, and annealing the armature to develop its magnetically soft properties. The forming of the spokes 18 also considerably stiffens the armature 12 and increases its resonant frequencies. The apertures 22 reduce the mass of the armature 12, and also control the saturation signal flux capability of the armature 12, and thereby some of the stability characteristics of the electromechanical transducer incorporating the armature, by constricting the signal flux to the spokes 18. The axis 24 is normal to the central portion 14 and is the desired direction of actuation of the armature 12 and its connecting aperture 20.

Figure 3:
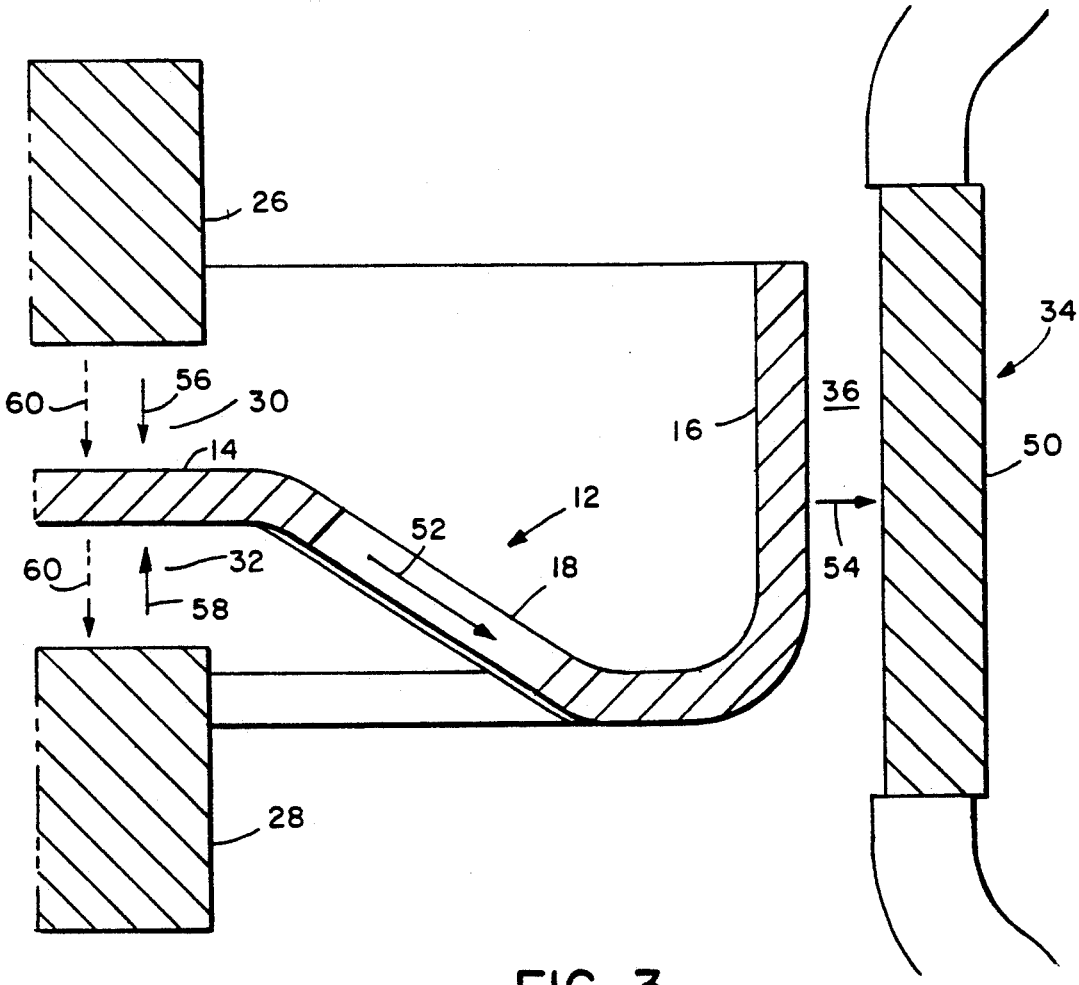
FIG. 3 is an enlarged fragmentary elevation in section showing parts of the armature of the first embodiment in the regions of the working and transverse gaps.
Figure 4:
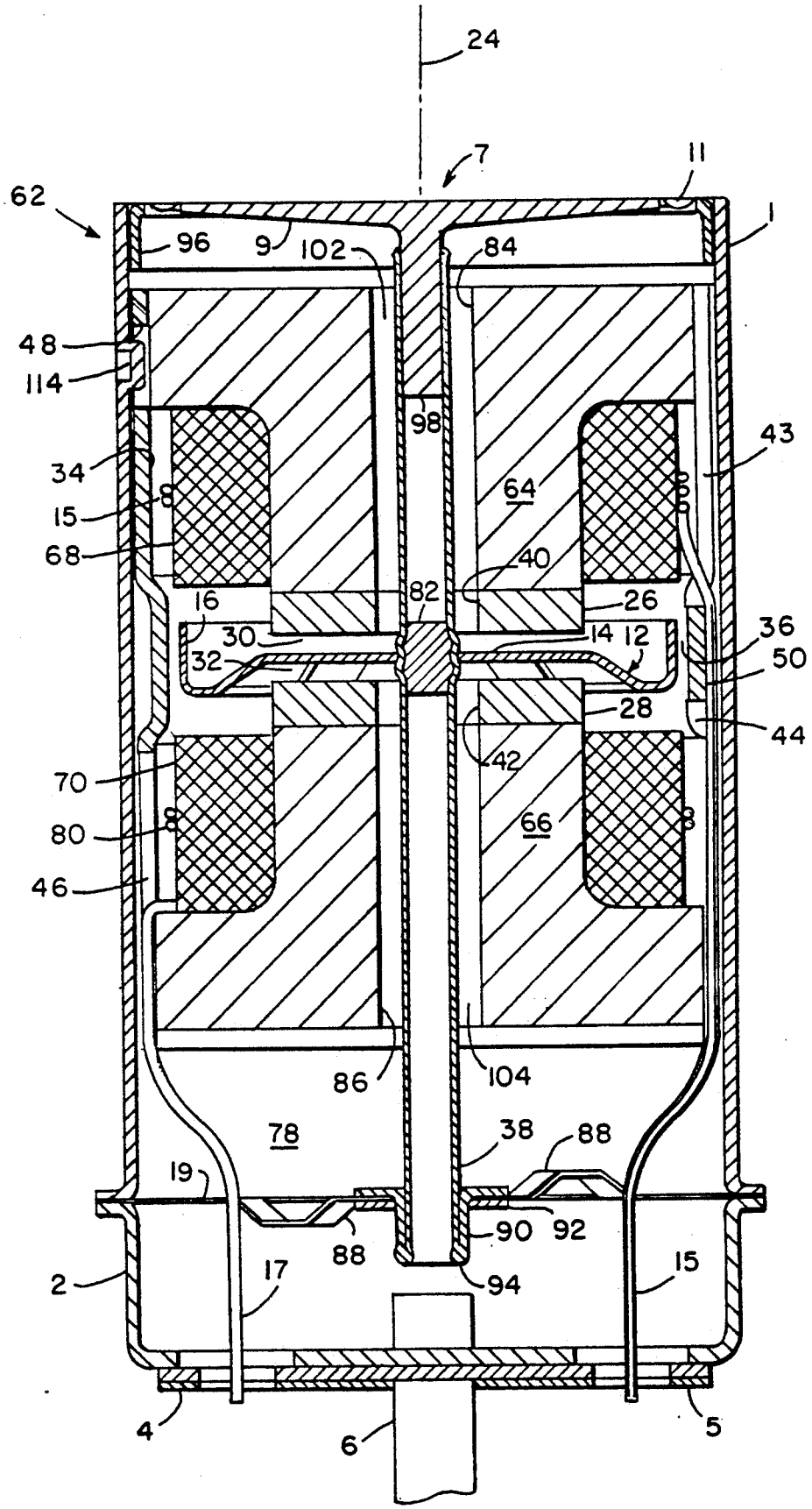
FIG. 4 is an elevation in longitudinal diametric section of the electroacoustic transducer of FIG. 1.
Figure 5:
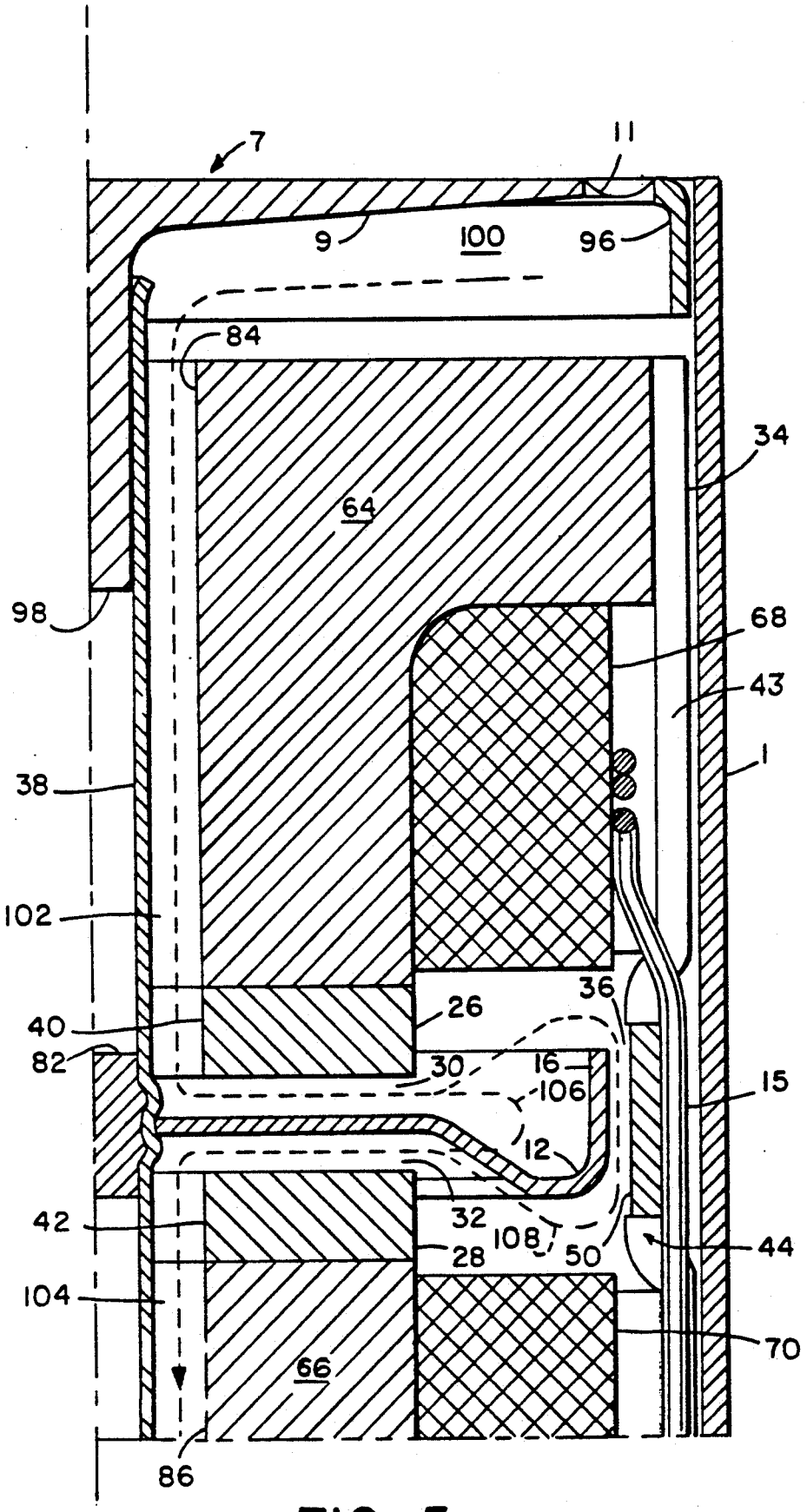
FIG. 5 is an enlarged fragmentary elevation of a portion of FIG. 4 showing internal acoustic flow paths.

FIGS. 3, 4 and 5 show the armature 12 in association with other parts of the transducer structure. Permanent magnets 26 and 28 oppose major faces of the central portion 14 of the armature 12 across respective working gaps 30 and 32. To minimize eddy current losses, the magnets 26 and 28 may be ferrite ceramic magnets, although these materials do have the disadvantage of relatively large temperature coefficients. The magnets 26 and 28 are magnetized in the same direction substantially parallel to the axis 24, and provide polarizing flux in the working gaps 30 and 32 that extends through the thickness of the central portion 14. The skirted rim 16 and the spokes 18 comprise a second part of the armature that extends from the central portion 14 substantially externally of the region of the working gaps. The skirted rim 16 of the armature 12 extends normal to the nominal plane of the central portion 14 and faces a sleeve 34, of magnetically soft material, across a circumferential transverse gap 36.

The sleeve 34 may be fabricated from seamless drawn tubing of a suitable nickel-iron alloy. At its aperture 20 the armature 12 carries a tubular central pin 38 which extends along the axis 24, and which may be fabricated from seamless hard drawn tubing of a suitable non-magnetic nickel alloy. The magnets 26 and 28 are apertured at 40 and 42 respectively to allow the passage of the central pin 38. Slots 43, 44 and 46 in the sleeve 34 provide passage for coil leads in the transducer. An aperture 48 (FIG. 4) provides a detent function in semi-locating the sleeve 34 within the tube 1. The sleeve 34 is swaged to smaller diameter at a band 50 where the sleeve faces the skirted rim 16 of the armature; the smaller diameter of the band 50 provides communication for coil leads between the slots 43 and 44, and the resulting form somewhat stiffens the extensively slotted sleeve 34. The slots 43, 44 and 46 also considerably reduce eddy current losses in the sleeve 34.

In the detail of FIG. 3, signal flux caused by current in the signal coils of the transducer, or by displacement of the armature 12 along the axis 24, or by both, is shown for definiteness as the outwardly directed portion 52 of the signal flux in the spoke 18. Corresponding signal flux 54 extends radially outward in the transverse gap 36 from the skirted rim 16 to the band 50 of the sleeve 34. Typically the signal flux divides between the gaps 30 and 32 as indicated qualitatively by arrows at 56 and 58 respectively, although in principle one of the signal fluxes may differ in sign from that indicated by the arrow 56 or 58.

However, with the signal fluxes directed as indicated at 56 and 58, and with the initial polarizing flux provided by the magnets as indicated by arrows at 60, the effect of the signal flux 54 is to increase the tractive force of the total flux in the gap 30 on the upper surface of the central portion 14, and to decrease the tractive force of the total flux in the gap 32 on the lower surface of the central portion 14. This imbalance between the opposing tractive forces results in a net upward force on the central portion 14. If the signal flux has the opposite sign from that of the arrow 54, a net downward force results on the central portion 14.

FIG. 4 shows a section of the electroacoustic transducer of FIG. 1 along its central axis, the transducer 62 incorporating the armature 12 of FIG. 2. FIG. 5 is a detail of a portion of FIG. 4.

Referring to FIGS. 4 and 5, two spool-like core pieces 64 and 66 back the magnets 26 and 28 respectively, and complete respective magnetic paths to the sleeve 34. The flanges of the core pieces 64 and 66 are a slip fit in the sleeve 34 and are fixed to it by adhesive bonding; likewise the magnets 26 and 28 are attached to the core pieces by adhesive. Typically the core pieces 64 and 66 are fabricated from a magnetically permeable manganese-zinc ferrite ceramic material to minimize eddy current losses while providing adequate flux density capability. Electrical signal coils 68 and 70 are wound on core pieces 64 and 66 respectively, using self-bonding wire and winding technique. The coils 68 and 70 may have integral skeined leads; if so, the outer lead of each coil wraps around the body of the coil to secure the outer lead to the coil.

Thus the outer lead 15 wraps around the coil 68 and extends along the slot 43 in the sleeve 34, and further extends between the band 50 and the tube 1, and along the slot 44, to pass into the acoustic cavity 78 and thence to pass through the terminal pad 5, to which the lead 15 is soldered (solder not shown). The corresponding outer lead 80 of the coil 70 wraps around the coil and extends along the slot 46 in the sleeve 34 to pass into the cavity 78; the extension is not shown because of the choice of sectioning plane for FIG. 4. The inner lead 17 of the coil 70 also extends along the slot 46 to pass into the cavity 78 and through the terminal pad 4, to which it is soldered (solder not shown). The corresponding inner lead of the coil 68 is not shown in FIG. 4, again because of the choice of sectioning plane, but extends roughly parallel with the outer lead 15 to pass into the cavity 78. In this embodiment the coils 68 and 70 are connected electrically in series such that the electrical current in each coil causes the same direction of signal flux in the transverse gap 36. The transducer is operative if there is only one electrical signal coil, such as the coil 68 alone or the coil 70 alone. In that case, however, the electromechanical coupling coefficient of the transducer is considerably degraded. Thus the pair of electrical signal coils is preferred. Although the coils discussed so far have two leads, some applications may require that each coil assembly, such as 68 or 70, be a quasi-bifilar wound pair of coils, with each coil assembly having at least three leads. In that case the two coil assemblies would ordinarily be connected electrically in parallel, for connection to a conventional three-terminal pushpull amplifier.

The tubular pin 38 is strongly secured to the armature 12 by means of a coined slug 82; the pressure of coining the slug 82 permanently bulges the pin 38 outwardly on each side of the central portion 14 in the vicinity of the aperture 20, thus locking the pin to the armature. The slug 82 may be cut from high strength aluminum alloy wire, and then annealed before being coined in place; preferably the aluminum alloy is chosen for room temperature age hardening subsequent to the coining operation.

The core pieces 64 and 66 have central apertures 84 and 86 respectively, corresponding to the apertures 40 and 42 in the magnets 26 and 28, to allow passage of the pin 38. The pin 38 extends through the aperture 84 for connection to the diaphragm assembly 7, and through the aperture 86 for connection to the restoring spring 19. The armature 12 is stabilized against magnetic snap over by the restoring spring 19.

Thus the restoring spring 19 has a peripheral rim, welded between the flanges of the tube 1 and cup 2, which is connected to an integral hub by four spokes 88 which operate primarily in flexure. The rim and hub of the restoring spring 19 are substantially coplanar, but the spokes 88 are formed along the axis 24 to provide a sufficient degree of linearity to the force/deflection characteristic of the restoring spring 19. In addition, alternate spokes 88 are formed in opposite directions to more nearly symmetrize this characteristic of the restoring spring 19. Even so the resulting spring characteristic is somewhat nonlinear, but the residual nonlinearity may be exploited to improve the global stability of the motor unit; this is true because the negative magnetic force (the snap over force) on the armature in the absence of signal current is similarly nonlinear with respect to armature deflection. The restoring spring 19 may be photoetched, and then formed and hardened, from thin strip of high fatigue strength material such as a stainless steel having marageing type hardening mechanisms. The hub of the restoring spring 19 is resistance welded between the flange of an eyelet 90 and a washer 92 to provide strong, consistent and stable connection to the pin 38, and this connection is completed by a laser weld between corresponding ends of the eyelet 90 and the tubular pin 38, as shown idealized at 94. The eyelet 90, and washer 92, may be fabricated from a nickel alloy chosen for welding compatibility with the pin 38.

Thus far the description of FIGS. 3, 4 and 5 has been primarily directed to the electromechanical motor unit contained within the electroacoustic transducer 62. The transducer 62 is completed by the diaphragm assembly 7 and its attachment to the tube 1 and the pin 38, and by the provision of the atmospheric vent 6 through the end wall of the cup 2. The diaphragm assembly has been partially described by reference to FIG. 1. The hot formed skirt of the diaphragm film is also hot adhesive bonded to a ring-like diaphragm frame 96 during fabrication of the diaphragm assembly 7, and thus is bonded and sealed to the adjacent walls of the tube 1 and frame 96, and is trapped between these walls. The diaphragm reinforcement 9, covered by the diaphragm film, has an integral stem 98 which inserts into and is adhesive bonded within the tubular pin 38, completing the attachment of the diaphragm assembly 7 to the electromechanical motor unit.

In this embodiment the diaphragm surround 11, in combination with the restoring spring 19, also provides lateral location to the pin 38 and the attached armature 12, to constrain the rim 16 of the armature to be approximately concentric within the band 50 of the sleeve 34. This constraint, while not absolute, due to the lateral elasticity of the diaphragm surround 11 and the restoring spring 19 and also the flexural vibrations of the pin 24, is sufficient for a practical transducer 62. In other embodiments lateral location may be provided in part by means other than a diaphragm surround such as 11. For example, there may be two restoring springs, with a restoring spring such as 19 near each end of a pin such as 38.

In the transducer embodiment 62 of FIG. 4, the major internal acoustic volume is provided by the cavity 78. As shown by FIG. 5, when the diaphragm reinforcement 9 and surround 11 vibrate, the volume displacement of the diaphragm is collected by a below-diaphragm cavity 100, but much of this tends to flow to or from the cavity 78. The sleeve 34 usually is adhesive bonded, and therefore substantially sealed, to the tube 1. Thus the apertures 84 and 86 in the core pieces 64 and 66 respectively, and the corresponding apertures 40 and 42 in the magnets 26 and 28, provide annular flow passages 102 and 104 surrounding the pin 38 that help connect the cavities 100 and 78. For example, when the diaphragm reinforcement 9 moves in the downward direction of FIGS. 4 and 5, air flow tends to occur down the passage 102, radially outward in the working gap 30, between the spokes 18 of the armature 12 as indicated schematically by a path 106, radially inward in the working gap 32, and down the passage 104 to reach the cavity 78. Some parallel flow also occurs axially along the transverse gap 36, as indicated by a path 108. The constricted passages 102 and 104 supply useful acoustic damping to the electroacoustic transducer 62, to the extent this damping is linear, but the cross sectional area provided to the flow by the passages 102 and 104, and the working gaps 30 and 32, must be sufficient to keep nonlinear distortion from jet and turbulence effects within acceptable limits.

The fabrication of the electroacoustic transducer 62 is preferably accomplished by forming a subassembly comprised of the flanged tube 1 and the slotted, swaged sleeve 34, and of all parts which are trapped by the sleeve 34 when the flanges of the core pieces 64 and 66 are adhesive bonded within the sleeve. Within the cavity 78 the inner lead of the coil 68 is connected to the lead 80, putting the coils 68 and 70 electrically in series. In this subassembly the sleeve 34 is semi-located within the tube 1 so that the sleeve cannot fall out during handling. Likewise the armature 12 and its attached tubular pin 38 are free to rattle to a certain extent; at this point the magnets are not magnetized.

Assembly continues with fixturing by resistance welding the peripheral rim of the restoring spring 19 to the flange of the tube 1, the pin 38 being slipped through the eyelet 90. With the armature 12 placed at the desired axial location, the tubular pin 38 and eyelet 90 are laser welded together as indicated at 94; before welding, the end of the pin 38 extends beyond the end of the eyelet 90 to provide filler material for welding. Then the terminal cup 2 is brought into position, with the leads 17 and 15 threading through the terminal pads 4 and 5 respectively, and the flanges of the cup 2 and tube 1 are resistance welded together with the peripheral rim of the restoring spring 19 between the flanges: the welds extend through the peripheral rim. If desired, the resistance welds may be substituted or reinforced by laser welds. Unless the combined rim of the flanges is completely sealed by welding, as by laser welding, the residual seams after welding are sealed by an adhesive capillaried into the seams.

At this point the leads 17 and 15 may be soldered to their respective terminal pads, and the magnets 26 and 28 within the assembly may be pulse magnetized by a magnetizing coil that surrounds the assembly and has its axis directed along the axis 24. During a portion of the current pulse through the magnetizing coil, most of the sleeve 34 is saturated magnetically so that it does not appreciably impede the magnetization of the magnets. After magnetization, the assembly is ready for unit adjustment in accordance with FIG. 6.

Subsequent to the unit adjustment operations to be described by reference to FIG. 6, it is convenient to insert the atmospheric vent 6 in an aperture 110 of the terminal cup 2, and to adhesive bond the vent 6 in place. Then the prefabricated diaphragm assembly 7 is inserted to complete the electroacoustic transducer 62. The integral stem 98 of the diaphragm reinforcement slips into the adjacent end of the tubular pin 38, and is bonded within the pin by pre-placed adhesive.

Likewise the film covered rim of the diaphragm frame 96 slips into the tube 1 and is bonded to it by pre-placed adhesive, closing that end of the tube 1.

Figure 6:
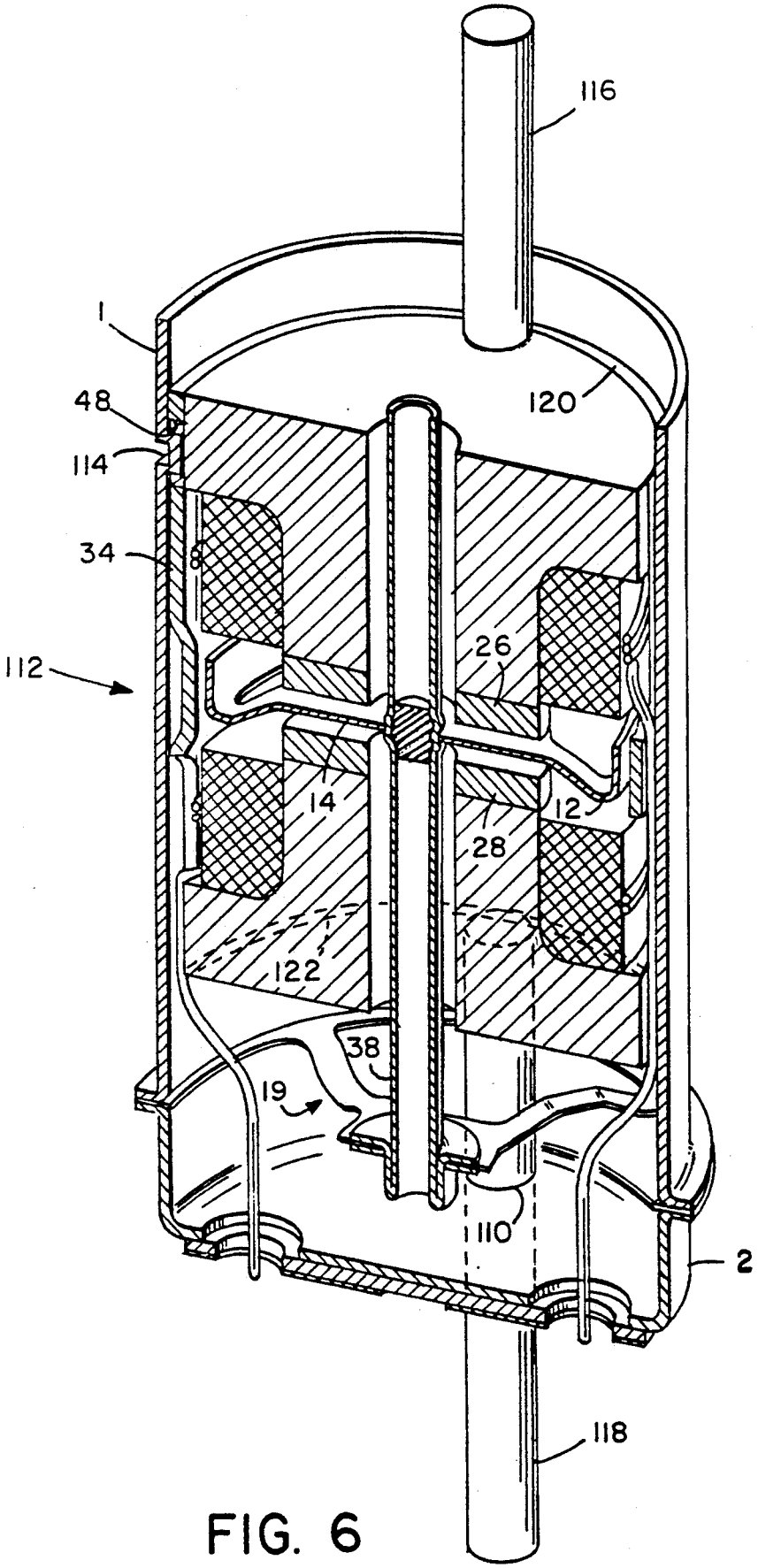
FIG. 6 is a view sectioned on a longitudinal diametric plane, showing the unit adjustment of the first embodiment.

FIG. 6 illustrates the unit adjustment of the electromechanical transducer 112. A boss 114 formed inward from the wall of the tube 1 engages the aperture 48 in the sleeve 34 to semi-locate the sleeve relative to the tube 1; the sleeve is free to move within the limits set by the aperture 48. In the aforementioned subassembly the boss 114 is already snapped in place into the aperture 48.

Referring to FIG. 6, the tube 1 is held in a fixture (not shown), and adjust pins 116 and 118 of the fixture bear upon edges 120 and 122 respectively of the sleeve 34. The adjust pin 118 reaches the edge 122 through the aperture 110. The armature 12 is held resiliently with respect to the tube 1 by the restoring spring 19, which is connected to the armature 12 by the pin 38. Within the limits allowed by the aperture 48, the axial position of the central portion 14 of the armature, relative to the magnets 26 and 28, may be adjusted as desired by pushing on adjust pin 116 or 118. Iteratively with this adjustment, the magnets 26 and 28 are partially demagnetized by a demagnetizing coil similar to the magnetizing coil used previously to magnetize the magnets 26 and 28. This demagnetization is carried out until the armature 12 is held stably in position by the restoring spring 19 and the desired electromechanical coupling coefficient is reached.

With the coupling coefficient achieved, and the armature 12 located as desired between the magnets 26 and 28, the sleeve 34 may be fixed to the tube 1, for example by laser welds through the wall of the tube 1.

Preferably the sleeve 34 is also adhesive bonded to the tube 1, and if desired this may be done subsequently when the diaphragm frame 96 of the electroacoustic transducer 62 is adhesive bonded into the tube 1.

Figure 7:
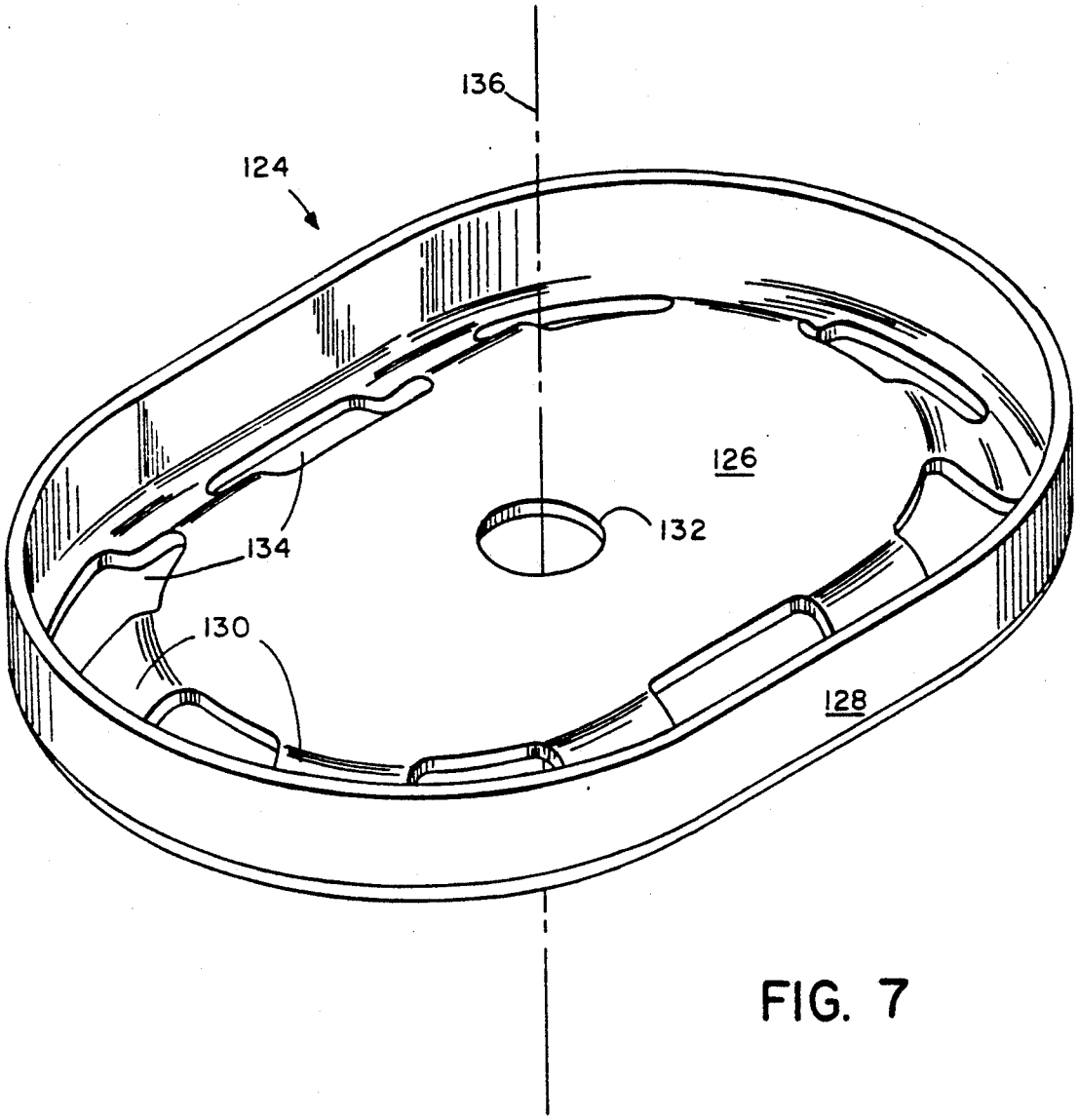
FIG. 7 is a detail view of an alternative embodiment of armature.

The transducers of the present invention need not have a casing of substantially cylindrical shape, and the casing need not have flanges, but such transducer may have a casing of any useful shape. However, a transducer casing of substantially cylindrical shape which has an oval cross section is particularly useful in many applications, and is relatively straightforward to manufacture. FIG. 7 of said copending application shows a transducer having such a casing in which flanges are used, although other means may be employed to close or complete the casing at its terminal end.

FIG. 7 shows an armature 124 of oval shape that is useful in an electroacoustic transducer similar to that of FIG. 7 in said copending application. The armature 124 of magnetically soft material has the flat central portion 126 and a skirted rim 128, both of oval shape, which are connected by eight formed spokes 130. The central portion 126 has a circular aperture 132 or optionally a polygonal aperture for mechanical connection, for example by means of a circular pin, to the armature 124. The spokes 130 are obtained by the blanking of eight apertures 134. The axis 136 is normal to the central portion 126 and is the desired direction of actuation of the armature 124 and its connecting aperture 132.

Figure 8:
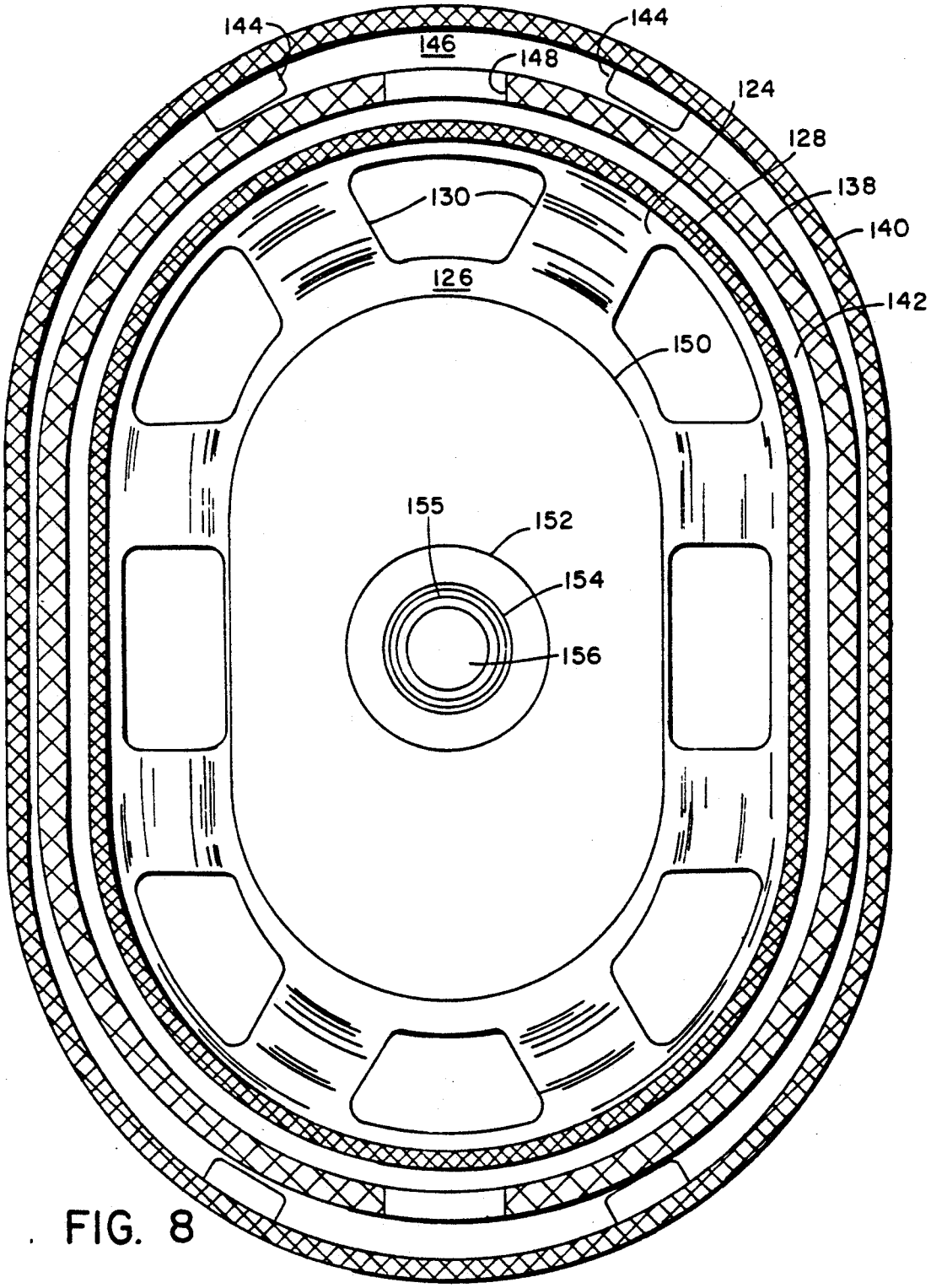
FIG. 8 is a fragmentary plan view of an electromechanical motor unit incorporating the armature embodiment of FIG. 7.

FIG. 8 shows the armature 124 in association with an oval sleeve 138 of magnetically soft material, which in turn is within an oval tubular casing 140.

Although FIG. 8 is not a section, the end edges of the casing 140, the sleeve 138, and the skirted rim 128 of the armature 124, are shown cross hatched for greater clarity. The sleeve 138 is not swaged to smaller girth, but is substantially cylindrical, and faces the skirted rim 128 of the armature across a transverse gap 142. The casing 140, shown without its optional flange, is more elongate in cross section than the sleeve 138. Location of the sleeve 138 within the casing 140 is completed by the eight formed bosses 144, similar to the boss 114 of FIG. 6, four of which are shown. Passageways 146 extending lengthwise between the sleeve 138 and casing 140, in combination with adjacent slots 148 in the sleeve 138, are provided for leads extending from an upper signal coil (not shown). A pair of oval magnets 150, having circular apertures 152, face across working gaps each side of the central portion 126 of the armature 124. A tubular pin 154 is attached to the central portion 126 of the armature at the aperture 132 of FIG. 7. Like pin 38, the pin 154 is flared somewhat near its upper end 155. As in FIG. 4, the tubular pin 154 is secured to the armature 124 by means of a coined slug 156.

Although not shown in FIG. 8, the pin 154 is attached to at least one restoring spring, which may be similar to the restoring spring 19. Unlike transducers of the present invention which employ a circular armature, the structure of FIG. 8 requires that the pin 154 locate the armature 124 sufficiently well with respect to rotation about the axis 136 to avoid rubbing between the skirted rim 128 and the sleeve 138. Thus the locking of the pin 154 to the central portion 126 with respect to rotation about the axis 136 may be improved by adhesive bonding, or preferably by blanking a non-round aperture, such as a hexagonal aperture in place of the circular aperture 132 of FIG. 7, in the central portion 126. When the slug 156 is coined in place, the tube of the pin 154 is swollen out into much of the non-round aperture, locking it securely to the armature 124 with respect to rotation. Also required in the structure of FIG. 8 is the initial rotational location of the armature 124 relative to the sleeve 138 upon performing the attachment of the pin 154 to the restoring spring, as by a laser weld such as 94.

I claim:

1. An electromechanical transducer including, in combination, means forming a magnetic circuit and comprising first and second permanent magnets, a structure substantially connecting a pair of opposite poles of the respective magnets, and a pair of opposed pole faces respectively adjacent the other pair of poles of the magnets, said circuit forming a bias field in a region between the pole faces, an armature having magnetically permeable first and second parts, the first part extending within said region and having a pair of major faces each opposing one of said pole faces across a working gap, the armature being vibratory in an operative direction to cause the working gaps to vary, means supporting the armature for vibration in said direction and resiliently tending to restore said first part to a predetermined position in said region, said second part extending toward said structure to form therewith a low reluctance gap between surfaces having substantial projections in said direction, said low reluctance gap completing respective signal flux conductive paths between said second part and each of said magnets, and an electrical signal coil located to be coupled to flux changes in a working gap.

2. A transducer according to claim 1, in which said second part of the armature has a constricted portion to substantially limit by magnetic saturation the excursion of signal flux in said low reluctance gap.

3. A transducer according to claim 1, in which said first part of the armature is of plate-like shape, and including an elongate pin attached to said first part and extending substantially normal to its nominal plane.

4. A transducer according to claim 3, in which said second part of the armature has a peripheral skirt facing said low reluctance gap and having a substantial projection along the extension of said pin.

5. A transducer according to claim 4, in which said peripheral skirt is substantially cylindrical.

6. A transducer according to claim 4, in which said second part includes a plurality of spokes substantially connecting said first part of the armature to said peripheral skirt.

7. A transducer according to claim 3, in which the permanent magnets are in the form of plates having central apertures, the pin extending through the apertures.

8. A transducer according to claim 1, comprising a magnetically permeable sleeve and a pair of magnetically permeable core pieces inserted in spaced relation within the sleeve, a portion of the sleeve opposing said second part of the armature across said low reluctance gap.

9. A transducer according to claim 3, in which the means supporting the armature includes a hub portion engaging the pin and a plurality of elastically flexible spokes extending from said hub portion.

10. A transducer according to claim 3, including diaphragm means engaging the pin near an end thereof and extending laterally of the pin.

11. A transducer according to claim 10, in which the permanent magnets are apertured, the pin extending through the apertures of the magnets, said apertures providing passages for acoustic flow within the transducer.

12. A transducer according to claim 1, in which said second part of the armature is free of mechanical restraint except by said first part.

13. A transducer according to claim 1, in which at least one of said surfaces forming the low reluctance gap extends substantially parallel to said operative direction, whereby the reluctance of said low reluctance gap does not vary appreciably as the armature vibrates.

14. A transducer according to claim 1, in which said means supporting the armature includes an elongate member extending substantially in said operative direction and a discrete restoring spring, said elongate member being attached to each of the armature and spring and connecting therebetween.

15. A transducer according to claim 14, including diaphragm means attached to said elongate member.

16. A transducer according to claim 1, including for each working gap an electrical signal coil coupled principally to that gap.

17. A low reluctance according to claim 16, including electrical connections to each of said coils, the connections providing signal currents in the coils to additively produce signal flux in said transverse gap.

18. An electroacoustic transducer having, in combination, a casing having a wall of hollow tubular shape and diaphragm means substantially closing the casing near one end thereof, a magnetically permeably sleeve received within the casing, a pair of spool-like magnetically permeable core pieces inserted in spaced relation within the sleeve, permanent magnets respectively attached to the core pieces and forming a bias field in a region between pole faces of opposite magnetic polarity, an armature connected to the diaphragm and having magnetically permeable first and second parts, the first part extending within said region and having a pair of major faces each opposing one of said pole faces across a working gap, the armature being vibratory in an operative direction to cause the working gaps to vary, the second part extending from the first part toward the sleeve and forming therewith a low reluctance gap between surfaces respectively having substantial projections in said direction, means supporting the armature for vibration in said direction and resiliently tending to restore said first part to a predetermined position in said region, and an electrical signal coil located to be coupled to flux changes in a working gap.

19. A low reluctance according to claim 18, in which said second part of the armature has a peripheral skirt facing said transverse gap.

20. A transducer according to claim 19, in which said second part of the armature also includes a plurality of spokes connecting to said first part of the armature, the spokes substantially limiting by magnetic saturation thereof the excursion of signal flux in said low reluctance gap.

21. A transducer according to claim 19, in which said sleeve is slotted locally to receive an electrical lead extending from said signal coil.

* * * * *

UNITED STATES PATENT AND TRADEMARK OFFICE

CERTIFICATE OF CORRECTION

PATENT NO. : 5,299,176

DATED : March 29, 1994

INVENTOR(S) : George C. Tibbetts

It is certified that error appears in the above-identified patent and that said Letters Patent is hereby corrected as shown below:

Column 10, line 25, (claim 17), cancel "transverse" and substitute --low reluctance--

Column 10, line 54, (claim 19), cancel "low reluctance" and substitute --transducer--

Column 10, line 56, (claim 19), cancel "transverse" and substitute --low reluctance--

Signed and Sealed this

Sixth Day of September, 1994

*Attest:*

Bruce Lehman

BRUCE LEHMAN

*Attesting Officer*

*Commissioner of Patents and Trademarks*